US005297747A

United States Patent [19]

Long

[11] Patent Number: 5,297,747

[45] Date of Patent: Mar. 29, 1994

[54] INDUCTION CORE WINDING DEVICE

[76] Inventor: Drewry B. Long, 15,500 N. Fifth Ave., P.O. Box 26, Lyons, Colo. 80540

[21] Appl. No.: 696,865

[22] Filed: May 8, 1991

[51] Int. Cl.[5] ..... B65H 81/02

[52] U.S. Cl. ..... 242/4 R; 242/4 C

[58] Field of Search ..... 242/4 R, 4 C, 5; 29/598, 605; 72/132, 148

[56] References Cited

U.S. PATENT DOCUMENTS

| | | | |
|---|---|---|---|
| 2,424,301 | 7/1947 | Boyer | 242/7.04 |
| 2,600,071 | 6/1952 | Nielsen | 242/4 R |
| 3,967,786 | 7/1976 | Ivanov | 242/4 R |
| 3,980,242 | 9/1976 | Schmidt | 242/4 C |
| 4,548,365 | 10/1985 | Marzec et al. | 242/4 R |

FOREIGN PATENT DOCUMENTS

| | | | |
|---|---|---|---|
| 222840 | 11/1942 | Fed. Rep. of Germany | 242/4 R |
| 186926 | 1/1983 | Japan | 242/4 R |
| 61-87312 | 2/1986 | Japan | 242/4 R |
| 63-47275 | 2/1988 | Japan | 242/4 R |
| 1-286410 | 11/1989 | Japan | 242/4 R |
| 543004 | 9/1939 | United Kingdom | 242/4 R |

*Primary Examiner*—Daniel P. Stodola
*Assistant Examiner*—Michael R. Mansen
*Attorney, Agent, or Firm*—Evenson, McKeown, Edwards & Lenahan

[57] ABSTRACT

Apparatus for winding an induction coil including a base plate formed with a winding aperture and a winding slot leading from an edge of the plate to the aperture, a pivot arm mounted under the base plate for reciprocating movement toward and away from the plate, a foot pedal or other device for reciprocating the pivot arm, a wire pulling hook on the pivot arm aligned with the winding aperture so that the hook moves back and forth through the aperture when the pivot arm is reciprocated, a spring biasing the pivot arm toward the base plate; and a clamp for holding a core in winding position over the aperture. A counter may be connected to the pivot arm to count the windings applied to the coil.

11 Claims, 1 Drawing Sheet

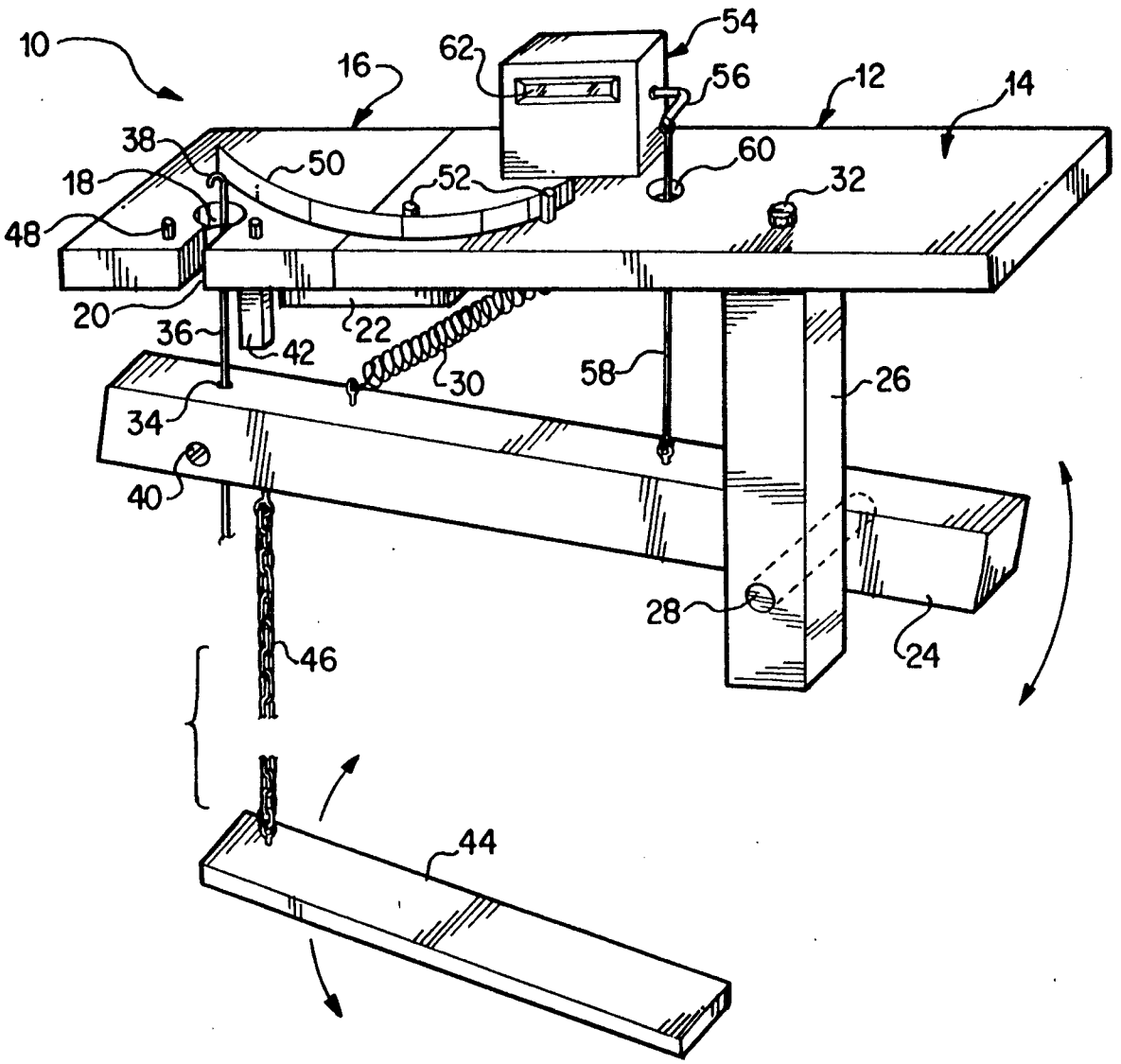
10
12
14
16
18
20
22
24
26
28
30
32
34
36
38
40
42
44
46
48
50
52
54
56
58
60
62

INDUCTION CORE WINDING DEVICE

BACKGROUND OF THE INVENTION

The present invention relates to an induction core winding device which can be used to facilitate winding of induction coils.

Induction coils used in a wide variety of electrical and electronic devices comprise a toroidal iron core with a plurality of turns of wire wrapped around the ring, i.e. down through the center and up around the outside. For many applications, such cores are wound by hand. Hand winding is awkward, time consuming and consequently expensive.

Attempts to automate core winding have produced devices which are unduly complex and expensive. In addition to the high initial investment, continuing expenditures of time and funds for maintenance are required.

There remains a need for a simple and comparatively inexpensive device for facilitating winding of cores which can enhance the capabilities of a human operator without requiring a large initial investment or substantial maintenance expenditures.

SUMMARY OF THE INVENTION

It is the object of the invention to provide an improved device for winding induction cores which has a comparatively uncomplicated structure.

Another object of the invention is to provide an induction core winding device which is relatively inexpensive to manufacture and requires only limited maintenance.

A further object of the invention is to provide an induction core winding device which is highly reliable and facilitates quality winding.

Yet another object of the invention is to provide an induction core winding device which is simple and easy to use, even by a comparatively untrained operator.

These and other objects of the invention are achieved by providing an induction core winding device comprising a base plate having a winding aperture therethrough and a winding slot leading from an edge of the plate to the aperture, a pivot arm mounted under the base plate for reciprocating movement toward and away the plate, means for controllably reciprocating the pivot arm, a wire pulling hook mounted on the pivot arm in alignment with the winding aperture such that when the pivot arm is pivoted toward the base plate, the hook will project a desired distance through the aperture, and when the pivot arm is pivoted away from the base plate, the hook will be withdrawn from the aperture, and a clamp for holding a core to be wound over the aperture.

BRIEF DESCRIPTION OF THE DRAWINGS

The invention will be explained in further detail with reference to the accompanying drawing figure which is a schematic prospective view of an induction core winding device according to the invention.

DETAILED DESCRIPTION OF PREFERRED EMBODIMENTS

The induction core winding device 10 according to the invention comprises a base plate 12 which in turn consists of a fixed portion 14 and an interchangeable portion 16. The interchangeable portion has a winding aperture 18 formed therethrough. Aperture 18 is connected to an adjacent edge of the base plate by a winding slot 20. As seen in the drawing figure, the width of winding slot 20 is less than the diameter of winding aperture 18. Interchangeable portion 16 is mounted on fixed portion 14 via an underlying support plate 22 by suitable fastening means, such as bolts or welds (not shown). By exchanging fixed portion 16 f or another such portion with a different size of aperture and slot, the apparatus can readily be adapted to the production of different size induction cores. Base plate 12 can be mounted at a convenient working height on legs (not shown) or clamped to an appropriate supporting surf ace such as a work bench or a counter top.

A pivot arm 24 is mounted underneath the base plate such that it can pivot in a reciprocating manner toward or away from the underside of the base plate. In the illustrated embodiment, pivot arm 24 is mounted on a depending pivot post 26 by, a pin 28. Pivot arm 24 is biased toward the underside of base plate 12 by a suitable spring, such as tension coil spring 30. Pivot post 26 is secured to base plate 12 by suitable means such as a bolt 32.

At the free end of pivot arm 24 there is a bore or sleeve 34 through which the stem 36 of a wire pulling hook 38 is extended. Sleeve 34 is aligned with winding aperture 18 so that when the pivot arm is raised, the hook will project through the winding aperture as shown in the drawing. The hook stem 36 can be raised or lowered relative to pivot arm 24 until the hook projects a desired distance through the aperture sufficient that it will extend all the way through the central aperture of a toroidal core being wound. The hook is then fastened in the desired position by means of set screw 40. A stop 42 may be provided on the underside of base plate 12 to limit the maximum upward movement of pivot arm 24.

The range of motion of pivot arm 24 should be sufficient that when the arm is pivoted downwardly, hook 38 is withdrawn from aperture 18 and will be accessible underneath base plate 12.

Suitable means are provided for drawing pivot arm downwardly against the force of tension spring 30. In the illustrated preferred embodiment, this is achieved by means of a foot pedal 44 which is connected to pivot arm 24 by means of a pedal chain 46. A treadle or other suitable reciprocating means might also be used.

Adjacent aperture 18 on top of base plate 12 are two spaced holding pins 48. The location of the pins is determined such that when the margin of a toroidal core to be wound using the apparatus of the invention rests against the pins, the central aperture of the core will be aligned with winding aperture 18. A tension spring 50 is provided on top of base plate 12 in a position such that it will urge a core to be wound against pins 48. Tension spring 50 is a leaf spring which is mounted on support posts 52. Spring 50 may be formed of any suitable material such as resilient plastic. The foregoing clamp arrangement is preferred for its simplicity, but it will be appreciated that alternative clamp arrangements could also be used.

For convenience in operation, a counter 54 may be mounted on top of base plate 12 in a position where it is readily viewable by the operator. The counter actuating arm 56 is connected by a cable 58 which extends through an aperture 60 in base plate 12 to pivot arm 24 such that the counter will be actuated every time pivot arm 24 is reciprocated downwardly by depressing foot pedal 44. The number of reciprocating movements executed by pivot arm 24 will thus be shown to the operator on counter display 62. This indicates the number of windings applied to the core.

In operation, a toroidal core to be wound is placed on top of base plate 12 over aperture 18 such that the periphery of the core is held against mounting pins 48 by the force of tension spring 50 and the central aperture of the toroidal core is substantially aligned with aperture 18. The operator then places a length of wire, which is to be wound around the core, under hook 38 and secures one free end of the wire. Foot pedal 44 is then depressed in order to pivot arm 24 downwardly and draw hook 38 through the central aperture of the core and through winding aperture 18, so that the hook portion is accessible underneath base plate 12. This pulls the wire through the center of the core. The operator then grasps the loop of wire pulled through by the hook, draws the free end of the wire through the aperture, and releases the foot pedal so that pivot arm 24 is raised again by spring 30. Hook 38 then extends again through aperture 18 and through the central aperture of the core to be wound so that it is accessible above the core. The operator then draws the wire through slot 20 and around the margin of the core and again places the wire under hook 38. The operation is then repeated to form an additional winding.

As each winding is formed, the operator can turn or rotate the core slightly so that successive windings are formed side by side until the windings cover a desired angular segment of the circumference of the core. The tension of spring 50 is sufficient to hold the core in place against pins 48, but is not so strong as to prevent manual turning of the core.

By winding several lengths of wire around different portions of the periphery of the core, a multi-coil core can be formed.

When display 62 of counter 54 shows the desired number of windings have been formed around the core, it can be removed from the apparatus and a new core begun.

It can be seen that the apparatus of the invention greatly simplifies the manual winding of cores and will enable even a relatively untrained worker to quickly produce quality windings. Due to its simple structure, the cost of initially manufacturing the apparatus of the invention is modest, and little or no maintenance is required.

The foregoing description has been set forth merely to illustrate the invention and is not intended to be limiting. Since modifications of the described embodiments incorporating the spirit and substance of the invention may occur to persons skilled in the art, the scope of the invention should be construed broadly to embrace everything within the ambit of the appended claims and equivalents.

What is claimed is:

1. An induction core winding device comprising:

a base plate having a winding aperture therethrough and a winding slot leading f rom an edge of said plate to said aperture;

a pivot arm mounted under said base plate for reciprocating movement toward and away from said base plate;

means for controllably reciprocating said pivot arm;

a wire pulling hook mounted on said pivot arm in alignment with said winding aperture such that when said pivot arm is pivoted toward said base plate, said hook will project a desired distance through said aperture, and when said pivot arm is pivoted away from said base plate, said hook will be withdrawn from said aperture; and a clamp for holding a core to be wound over said aperture on a side of said base plate opposite said pivot arm.

2. A device according to claim 1, further comprising a spring biasing said pivot arm toward said base plate.

3. A device according to claim 1, wherein said reciprocating means include a foot pedal operatively connected to said pivot arm for reciprocating said pivot arm.

4. A device according to claim 1, further comprising a counter operatively connected to said pivot arm for counting reciprocation of said pivot arm.

5. A device according to claim 1, wherein said hook is adjustable in length to vary the distance which said hook projects through said aperture in order to accommodate coils of differing thickness.

6. A device according to claim 5, wherein said hook is slidably received in a sleeve and secured in place within said sleeve by a set screw.

7. A device according to claim 1, wherein said winding aperture and winding slot are formed in an interchangeable base plate portion means for facilitating changing aperture and slot sizes for winding different size coils.

8. A device according to claim 1, wherein said clamp comprises a pair of spaced posts adjacent said winding aperture and a leaf spring for urging a coil against said posts.

9. A device according to claim 1, further comprising a stop under said base plate for limiting the travel of said pivot arm toward said base plate.

10. A device according to claim 1, wherein the winding slot has a width which is smaller than the winding aperture.

11. An induction core winding device comprising:

a base plate having two opposite sides with a winding aperture extending therethrough from one side to the other and a winding slot leading from an edge of said plate to said aperture;

a pivot arm mounted on one side of said base plate for reciprocating movement toward and away from said base plate;

means for controllably reciprocating said pivot arm;

a wire pulling hook mounted on said pivot arm in alignment with said winding aperture such that when said pivot arm is pivoted toward said base plate, said hook will project a desired distance through said aperture, and when said pivot arm is pivoted away from said base plate, said hook will be withdrawn from said aperture; and a clamp for holding a core to be wound on the other side of said base plate over said aperture.

* * * * *